US005117920A

United States Patent [19]

Soble

[11] Patent Number: 5,117,920

[45] Date of Patent: Jun. 2, 1992

[54] POLE DRIVER

[76] Inventor: Bernard D. Soble, 16191 W. 11 Mile, Apt. 106, Southfield, Mich. 48076

[21] Appl. No.: 515,102

[22] Filed: Apr. 27, 1990

[51] Int. Cl.[5] ..... E21B 7/02

[52] U.S. Cl. ..... 173/28; 173/39; 173/126

[58] Field of Search ..... 173/22, 28, 39, 44, 173/126, 89, 23; 272/118

[56] References Cited

U.S. PATENT DOCUMENTS

| | | | |
|---|---|---|---|
| 607,577 | 7/1898 | Tipton | 173/39 |
| 3,447,613 | 6/1969 | Lisenby | 173/28 |
| 3,490,548 | 1/1970 | Lake | 173/28 |
| 3,507,338 | 4/1970 | McWaters et al. | 173/28 |
| 3,717,342 | 2/1973 | Haney et al. | 272/118 |
| 3,934,655 | 1/1976 | Whistle | 173/28 |
| 4,050,526 | 9/1977 | Deike | 173/28 |
| 4,809,973 | 3/1989 | Johns | 272/118 |

*Primary Examiner*—Frank T. Yost
*Assistant Examiner*—Scott A. Smith
*Attorney, Agent, or Firm*—Krass & Young

[57] ABSTRACT

A pole driver 10 has a platform 12 on wheels 14 and 16 with leveling lift jacks 18 to assure horizontal orientation of the platform. A hammer drive assembly 24 is pivotally mounted on the platform 12 between a horizontal travel position and a vertical operating position. The hammer drive assembly includes a channel guide 34 and slide rail 36 with a weight 78 attached at a bottom end thereof. An operating handle 46 is mounted on the bottom section of the channel guide 34. A pair of brackets 66 are mounted under the slide rail assembly 24 to vertically orient a pole 74 under the weight 78 to be pounded into the soil by the slide rail 36 and weight 78.

11 Claims, 3 Drawing Sheets

POLE DRIVER

TECHNICAL FIELD

This invention relates to pole drivers and more particularly to portable pole drivers for driving poles vertically into the ground.

BACKGROUND OF THE INVENTION

Pole drivers are often used to pound a pole vertically into the ground. The poles can be used for fencing or load bearing support. Prior drivers are often attached to the back of a tractor in which the tractor has to rest on nearly horizontal ground and the operator has to hold the pole in a near vertical position and operate the driver to pound the pole into the ground. Precision for a fence pole or other similar pole is not necessary as long as the pole is near vertical.

However, poles preferably in tubular steel configuration are now being used to support car ports and the like which need to be precisely positioned. These poles are driven into the ground and function as footings. Drivers having more precision are needed to assure that a pole footing is vertical. Drivers that have a driving weight mounted to be cushioned with respect to the driver are also desirable.

SUMMARY OF THE INVENTION

In accordance with one aspect of the invention, a pole driver for driving poles into the ground has a portable platform or other housing in the form of a trailer mounted on wheels. Lift jacks preferably three in number lift and support the trailer at a horizontal position above the ground. A hammer drive assembly is pivotably mounted to the trailer and is movable between a horizontal travel position and a vertical operating position. A motor is mounted on the trailer and is operably connected to the hammer drive assembly via a lifting piston and cylinder assembly to move the hammer drive assembly between the vertical and horizontal positions.

Preferably, the hammer drive assembly includes a channel guide and a slide rail slidably mounted in the channel guide for vertical motion with respect thereto when the channel guide is in the vertical position. The slide rail has a weight at its bottom end. The motor operates a drive wheel at a top portion of the channel which is selectively engageable to the slide rail and weight for vertically lifting the slide rail and weight in the channel. A brake assembly is mounted at the top portion of the channel for stopping the slide rail and weight. An operable handle is mounted at the bottom portion of the channel for operating the brake assembly and for engaging the drive wheel to the slide rail.

A pole holding mechanism is mounted under the channel for slidably positioning a pole under the slide rail and weight in a vertical position. Desirably the pole holding mechanism includes two opposing semi-arcuate brackets that are positioned about the pole to slidably hold the pole in a vertical position and to allow the pole to slide therethrough when pounded by the weight from above. Each semi-arcuate bracket is preferably affixed to a horizontal rod that is slidably mounted in a sleeve that in turn is affixed to the trailer carriage. A fastener mechanism preferably a lock pin and hole assembly locks the semi-arcuate brackets in position.

In one embodiment, the weight includes a pin extending from the weight and is parallel to the slide rail. A plurality of weight plates each having an opening therethrough can be mounted onto the pin. A retainer retains the weight plates on the pin during lifting and dropping of the weight. The addition of a selected plurality of weight plates allows more precise matching of the forces available from the dropping weights to the force needed to drive a pole into various types of ground and soil.

Another aspect of the invention relates to a pole driver having a housing mounting a hammer drive assembly. The hammer drive assembly includes a slide rail that has a generally U-shaped cross section forming an interior channel space. The weight is mounted at the bottom end of the channel guide aligned with the channel space. A pin extends from the weight to the channel space and a plurality of weight plates having apertures therethrough each are mountable onto the pin. A retainer mechanism retains the plates on the pin.

In one embodiment the weight is mounted on the slide rail for cushioning of the shock during operation of the driver. In one embodiment, the mount includes a bracket means extending from the slide rail. The weight is slidably mounted to the bracket mechanism with a spring interposed between the slide rail and the weight which undergoes compression during impact of the weight onto the pole member. The compression of the spring cushions the shock transferred from the weight to the trailer.

The three lift jacks can be placed on uneven or sloped terrain and be operated to level the trailer to provide a vertically oriented hammer drive assembly. The brackets that hold the pole are mounted on the trailer such that when the trailer is properly leveled over the ground, the brackets are automatically properly positioned to hold the pole in a vertical orientation. Furthermore, an operating handle is mounted on the lower portion of the channel remote from the drive wheel and brake. The channel guide can be elevated and the slide rail can be elevated and elongated so the upper portion with the drive wheel and brake are above the reach of the operator. The elevation and elongation allow the driver to be used with longer poles. The low position of the handle allows the operator to control the brake and drive wheel which may otherwise be positioned out of reach. Furthermore, the weight by being spring loaded on the channel dampens shocks which further stabilizes the trailer in its desired position.

BRIEF DESCRIPTION OF THE DRAWINGS

Reference now is made to the accompanying drawings in which.

DETAILED DESCRIPTION OF THE PREFERRED EMBODIMENT

Figure 1:
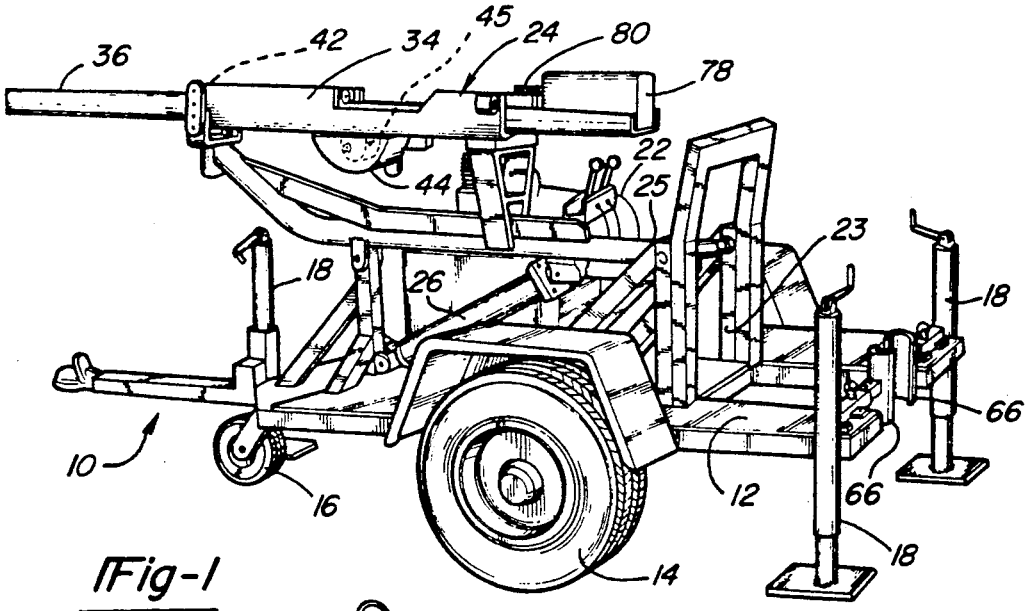
FIG. 1 is a perspective view of a pole driver with its hammer drive assembly in the travel position.

Referring to FIG. 1, a pole driver 10 has a base platform 12 mounted on wheels 14 and pivoting wheel 16 to form a trailer. A hydraulic motor 22 is mounted on platform 12. Three hydraulic lifting jacks 18 are mounted at three extremes of the base platform 12 to lift the base platform 12 to a level position above the ground 20. The jacks 18 can either be hand operated or operably connected to motor 22. A hammer drive assembly 24 is horizontally mounted on platform 12 for pivotal movement about axis 25 which is mounted via the appropriate support beams 23 to be pivoted to a vertical position shown in FIG. 2. A hydraulic cylinder assembly 26 having one end connected to the platform and another end connected to the assembly 24 is operably connected to hydraulic motor 22 for pivoting the hammer drive assembly 24 between the horizontal position and vertical position as shown in FIGS. 1 and 2.

Figure 7:
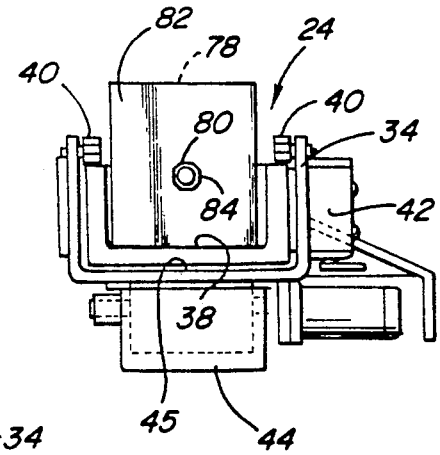
FIG. 7 is a top plan view of the slide rail and channel guide.

In particular, the hammer drive assembly 24 includes a boom 30 which has one end pivotally connected to axis 25 and the second end connected to an upper end 32 of a channel guide 34. The channel guide 34 is U-shaped as shown in FIG. 7. A slide rail 36 is slidably mounted in the channel guide. The slide rail is also generally U-shaped that forms a channel space 38 therein. The slide rail is retained in the channel guide 34 via a plurality of guide wheels 40 spaced along the channel guide 34.

Figure 2:
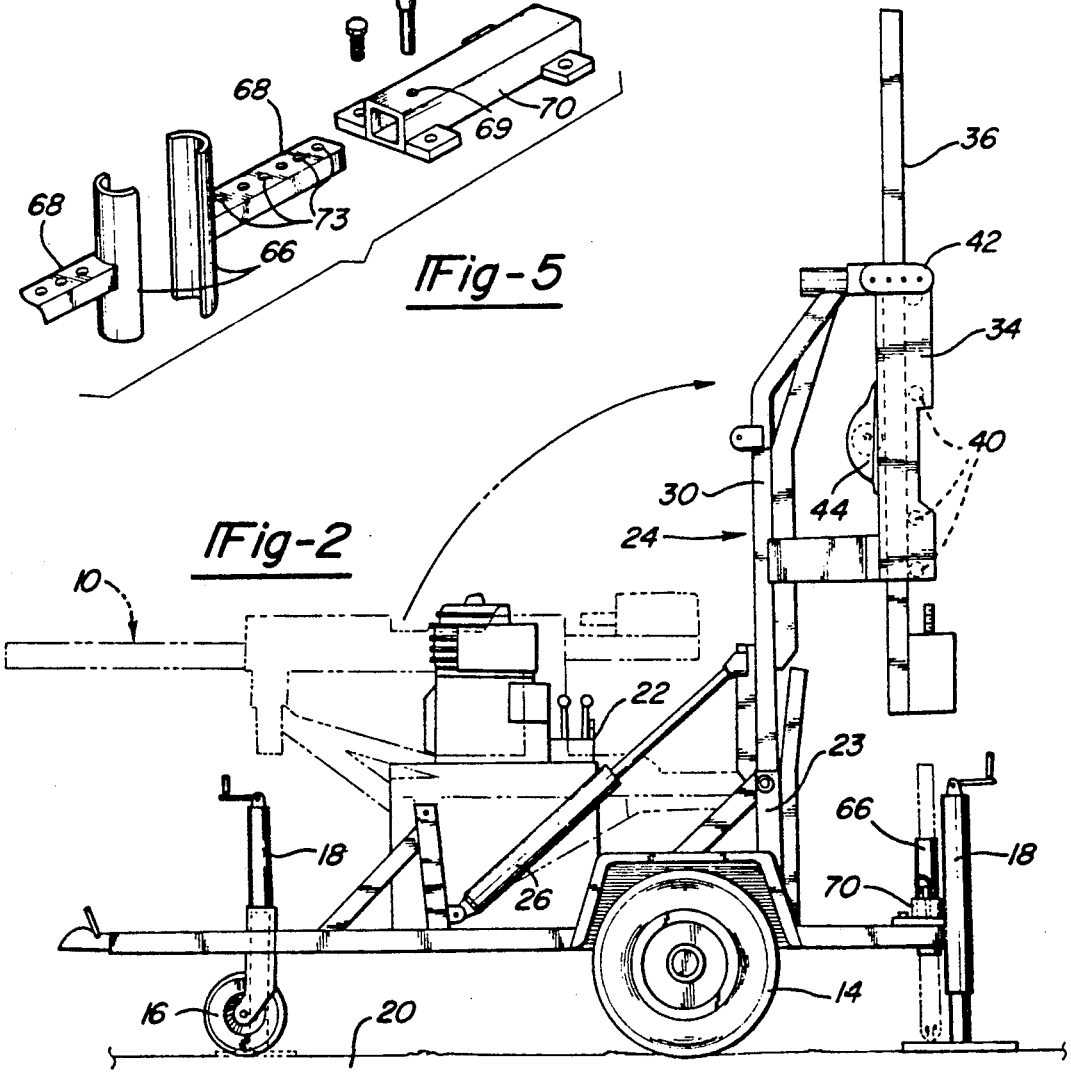
FIG. 2 is a side view of the trailer with the hammer drive assembly in its operating position.
Figure 3:
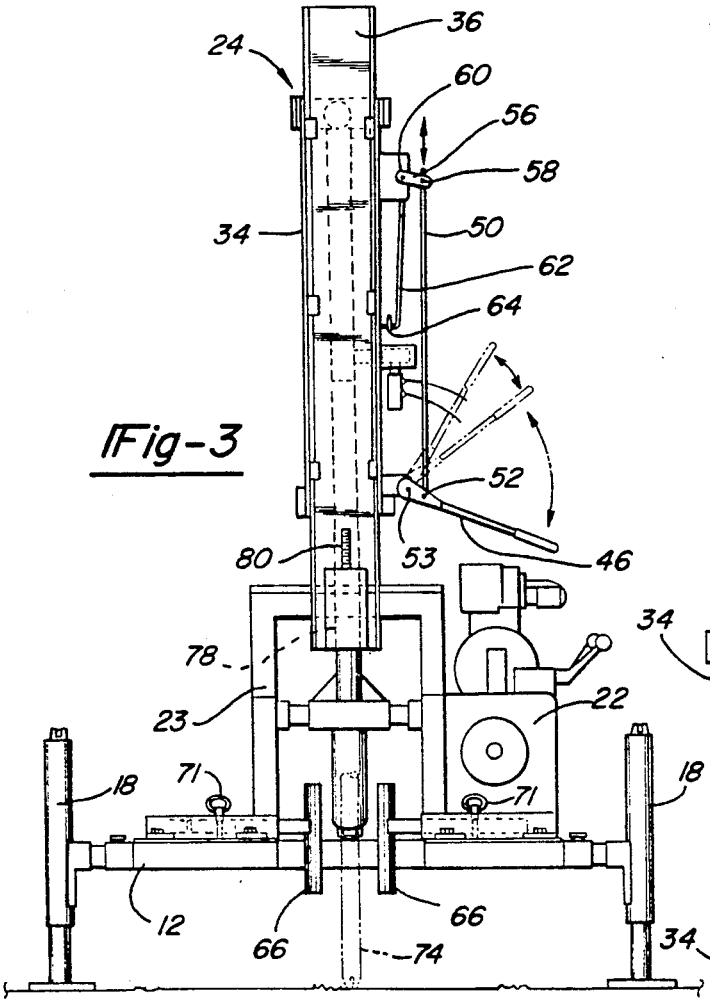
FIG. 3 is a back view of the pole driver shown in FIG. 2.
Figure 6:
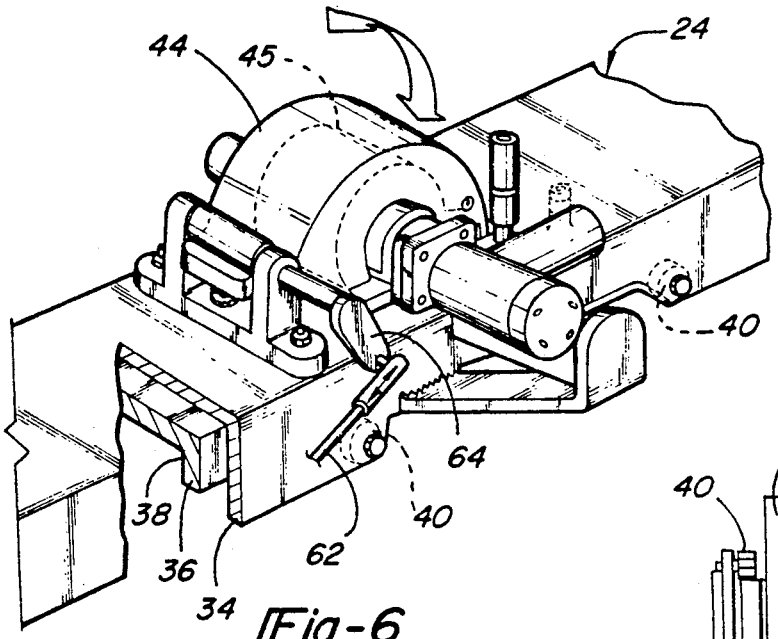
FIG. 6 is a rear perspective and partially segmented view of the lifting mechanism for the slide rail.

As shown in FIG. 2, the upper end 32 of the channel guide 34 has a brake assembly 42. Below the brake assembly 42 is a drive wheel assembly 44 that includes a hard rubber wheel 45 as shown in FIG. 6. The drive wheel assembly 44 has appropriate strength to lift slide rail 36 as described in more detail below. Both the drive wheel and brake assembly are operated by a handle mechanism 46 mounted at the bottom end 48 of the channel guide 34. The handle 46 is connected via an upwardly extending linkage 50 to the drive wheel 44 and brake assembly 42. As shown in FIG. 3, the handle has three operating positions with the upper position being the neutral position, the lower position being a position which engages the drive wheel to the slide rail 36 and a middle position which actuates the brake assembly 42. More particularly, the linkage 50 is connected to a handle 46 at a point 52 spaced from the pivot point 53 of the handle. Similarly, the linkage 50 is connected to the brake lever 56 at a point 58 spaced from its pivot point 60. A second parallel linkage 62 extends similarly from the lever 56 to lever 64 in a similar fashion to control the position of the hydraulic drive wheel 44.

Figure 5:
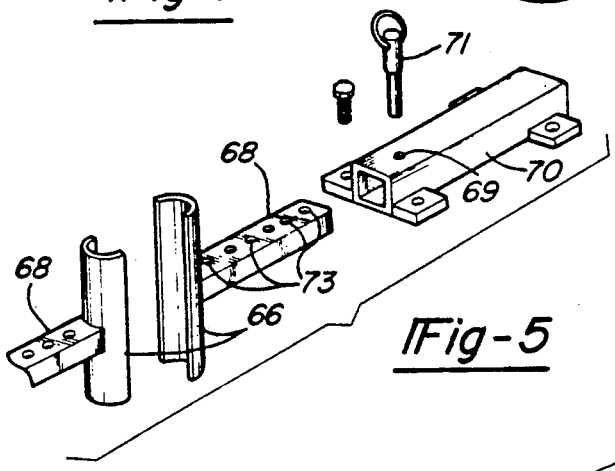
FIG. 5 is an exploded view of the pole holding mechanism for the pole shown in FIGS. 3 and 4.
Figure 4:
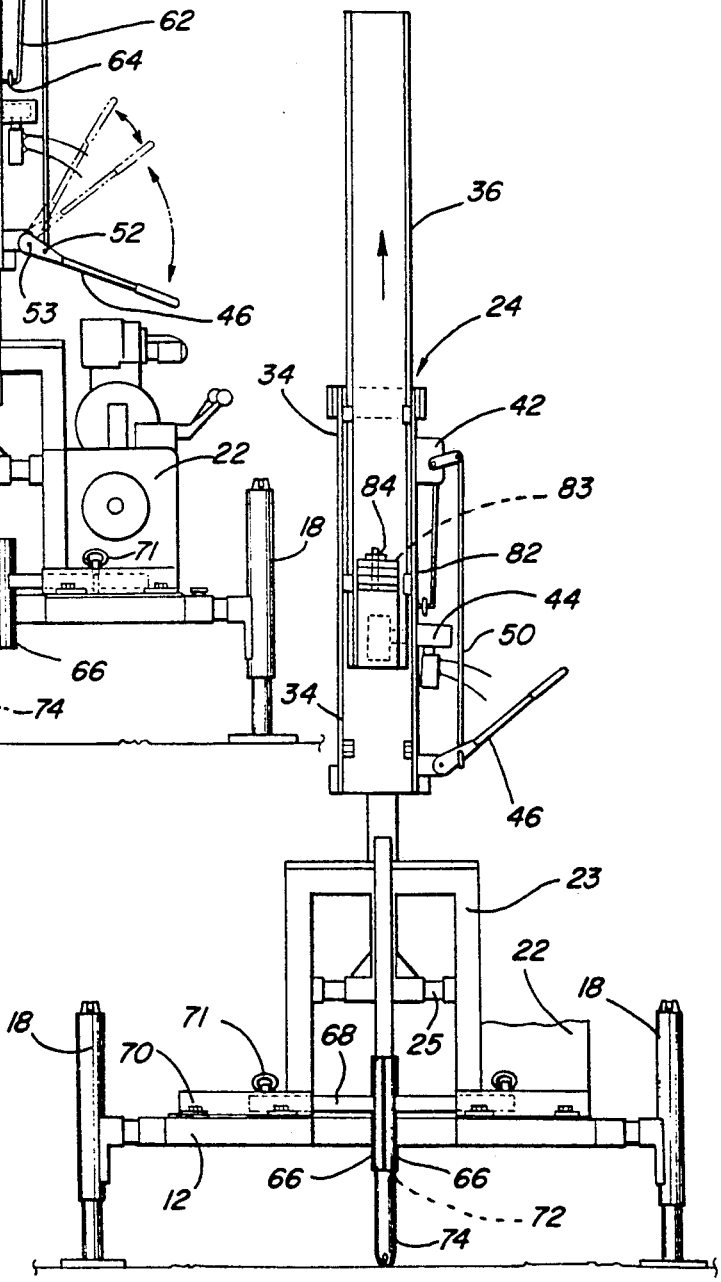
FIG. 4 is a view similar to FIG. 3 showing the weight and slide rail in the raised position and the pole holding mechanism holding a pole in the proper position.

As shown in FIGS. 3 and 4, a pole is positioned under the slide rail 36 and engages a pair of opposing semiarcuate brackets 66. Each bracket 66 is fixed to a rod 68 which is slidably received in a sleeve 70 which is fixedly secured to the platform 12. The rods 68 are slidable so that the semi-arcuate bracket 66 can be spaced apart or can abut each other to form a tubular aperture 72 which can slidably receive a pole 74. The semi-arcuate brackets 66 are vertically oriented with respect to the base platform 12 such that when the platform 12 is leveled via the lift jacks 18, the brackets 66 when engaging the pole 74 automatically provides for a vertical orientation of the pole. A lock pin 71 as shown in FIG. 5 passes through apertures 69 in sleeve 70 and one of apertures 73 in rod 68 to lock bracket 66 in place.

The bottom end of the slide rail 36 includes a weight 78 that is welded thereon. The weight 78 can be a rectangular block sized to fit within the slide rail channel space 38. A pin 80 is fixed to the weight and extends along the channel space 38 to allow for the mounting of a selected plurality of weight plates 82. The weight plates 82 can be selectively chosen to match appropriate weight for driving the pole due to the different soil and ground conditions. Different weight can also be used for driving differently sized poles in length and diameter. The plurality of weight plates include apertures 83 which are sized to receive the pin 80. The nut 84 is then threaded onto a threaded end section of pin 80 to retain the weight plates 82 thereon during operation of the hammer drive assembly 24. Each plate 82 as shown in FIG. 7 extends into channel 38.

The operation of the pole driver commences with the proper positioning of the base platform 12. The base platform is wheeled or trailed to its desired location via hitch mount 76. The proper angle of the platform can be achieved by turning the platform on its pivot wheel 16. Once the proper location is achieved the platform is then leveled via lift jacks 18. A leveler can be used to precisely check the inclination of the platform. A pole is then placed between the arcuate brackets 66 and the arcuate brackets are then enclosed on the pole to achieve the proper vertical orientation on the pole. The hydraulic cylinder 28 is then actuated to pivot the slide rail assembly 24 from its horizontal to its vertical position. The handle is then operated to engage the drive wheel 44 to the slide rail to lift the slide rail and weight.

The slide rail 36 and weight 78 are then lifted to the upper reaches of the channel guide 34. The handle 46 is then operated to disengage drive wheel 44 therefrom, brake the slide rail 36, and then to release it such that the slide rail 36 and weight 78 come falling down onto the top of the pole 74. The pole 74 is allowed to slide within the hole 72 defined by arcuate brackets 66 to drive it into the ground. The lifting and dropping of the weight 78 and slide rail 36 are repeated as necessary until the pole 74 is driven in its desired distance into the ground. If the pole needs to go lower than the arcuate bracket assembly the brackets 66 can be opened when the top of the pole reaches the bracket assembly to allow the pole to be fully driven into the ground.

Figure 8:
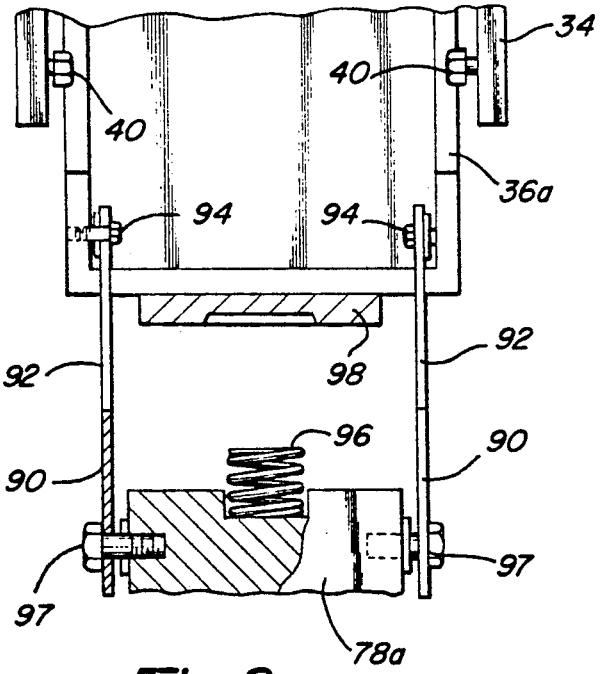
FIG. 8 is an enlarged view of a spring loaded weight attached to the slide rail.

As shown in FIG. 8, an alternate mounting of the weight shows a weight **78*a* being spring cushioned onto the slide rail 36*a* to lessen the shock impact of the weight transferred to the slide rail as the weight is dropped onto the top of the pole 74. In FIG. 8, the channel slide rail 36*a* has two brackets 90 bolted thereto and extending downwardly therefrom. Each bracket has vertical slots 92 which are mounted onto bolts 94 affixed to slide rail 36*a*. Fastener 97 affix brackets 90 to the weight 78*a*. Spring 96 is mounted to top of weight 78*a*. The bottom of the slide rail 36*a* has a spring abutment 98 extending thereacross. After the weight 78*a* impacts the pole, the weight 78*a* slides via the bolts 94 within slots 92 until the spring 96 between the weight 78*a* and spring abutment 98** is compressed thereby cushioning the shock. The cushioning is desirable if certain hard ground conditions exist. The cushions isolate any excessive vibration from the platform to stabilize the platform in its desired location.

The advantages of a pole driver constructed as described above are numerous and all tend to provide ease of operation in driving a pole into the ground. Firstly, the pole driver is easily portable and can be hitched to the back of a pick-up truck or similar towing vehicle. Secondly, the platform is easily positioned in its desired location. Thirdly, the lift jacks assure that the platform can be horizontally oriented. Fourthly, once the platform is horizontally oriented, the pole is easily oriented in a vertical position via the brackets 66. Fifthly, the remote handle is easily reachable to the operator even though the slide rail and channel guide can extend great lengths vertically in the air beyond the reach of an operator. Alternatively, this function can be operated electrically and remotely from the platform. The remote handle still allows for operation and accessibility to the brake and drive wheel. Furthermore, the pin assembly which allows for the mounting of additional weight plates provided for a matching of the force available from the weights dropping to the force needed for particular pole insertion into the ground of particular soil conditions. Lastly, the cushioning of the spring allows for less impact vibrations to be transferred to the base platform 12 from the weight 78*a*.

In this fashion an advantageous pole driver is achieved with the aforementioned advantages, structure and function.

Variations and modifications of the present invention are possible without departing from its spirit and scope as defined by the appended claims.

The embodiments in which an exclusive property and privilege is claimed are defined as follows:

1. A pole driver for driving support poles into the ground; said driver characterized by:

a platform;

a plurality of lift jacks for supporting said platform above said ground in a substantially horizontal orientation;

a motor mounted to said platform;

a hammer drive assembly pivotally mounted to said platform and movable between a horizontal travel position and a vertical operating position;

means operably connected to said motor for moving said hammer drive assembly between said horizontal travel position and said vertical operating position;

said hammer drive assembly including a channel guide, and a slide rail slidably mounted in said channel guide for vertical motion with respect thereto, said slide rail having a weight mounted at the bottom end thereof;

said motor operably and selectively engageable to said slide rail for vertically lifting said slide rail and weight in said channel;

a brake assembly mounted at a top portion of said channel for braking said slide rail and weight;

an operating handle mounted at a bottom portion of said channel for operating said brake assembly and for selectively engaging said motor to said slide rail; and a pole holding means mounted on said platform and vertically oriented with respect thereto, for slidably positioning a pole under said slide rail and weight in a vertical position, said weight includes a pin extending from said weight and parallel to said rail; a plurality of weight plates having an opening therethrough for being mounted onto said pin and retaining means for retaining said weight plates on said pin.

2. A pole driver as defined in claim 1 further characterized by:

said pole holding means includes two opposing brackets that are positioned about said pole to slidably holding said pole in a vertical position.

3. A pole driver as defined in claim 2 further characterized by:

each bracket is affixed to a rod that is slidably mounted in a sleeve that is affixed to said platform.

4. A pole driver as defined in claim 2 further characterized by:

each bracket has a semi-arcuate section which abuts against said pole.

5. A pole driver as defined in claim 1 further characterized by:

said slide rail having a U-shaped cross section defining a channel space therein:

said pin extending from said weight to said channel space;

said plurality of plates when mounted on said pin extend into said channel space.

6. A pole driver as defined in claim 6 further characterized by:

said weight being slidably mounted to said slide rail with a spring interposed therebetween.

7. A pole driver for driving support poles into the ground, said driver characterized by:

a housing;

a hammer drive assembly including a vertical channel guide, and a slide rail mounted in said channel guide for vertical motion with respect to said guide;

said slide rail having a generally U-shaped cross section forming an interior channel space and a weight mounted at its bottom end aligned with said channel space;

a pin extending from said weight into said channel space;

a plurality of weight plates having an aperture therethrough and mountable onto said pin;

retaining means for retaining said plates onto said pin.

8. A pole driver as defined in claim 7 further characterized by:

a pole holding means positioned under said weight for slidably positioning a pole under said weight in a vertical position.

9. A pole driver as defined in claim 8 further characterized by:

said pole holding means includes two opposing brackets that are positioned about said pole to slidably holding said pole in a vertical position.

10. A pole driver as defined in claim 9 further characterized by:

each bracket has a semi-arcuate section which abuts against said pole.

11. A pole driver as defined in claim 10 further characterized by:

each semi-arcuate section is affixed to a rod that is slidably mounted in a sleeve that is affixed to said housing.

* * * * *